US007533623B2

(12) United States Patent
Tostevin

(10) Patent No.: US 7,533,623 B2
(45) Date of Patent: May 19, 2009

(54) SAILING BOATS

(76) Inventor: Richard Edmund Tostevin, La Baise, La Viltole, Torteval, Guernsey (GB) GY8 0PR ( * ) Notice: Subject to any disclaimer, the term of this patent is extended or adjusted under 35 U.S.C. 154(b) by 0 days.

(21) Appl. No.: 10/561,666

(22) PCT Filed: Jun. 9, 2004

(86) PCT No.: PCT/GB2004/002481

§ 371 (c)(1),
(2), (4) Date: Dec. 20, 2005

(87) PCT Pub. No.: WO2004/113160

PCT Pub. Date: Dec. 29, 2004

(65) Prior Publication Data

US 2007/0095267 A1 May 3, 2007

(30) Foreign Application Priority Data

Jun. 20, 2003 (GB) ..... 0314441.7
Sep. 2, 2003 (GB) ..... 0320544.0

(51) Int. Cl.
*B63B 15/00* (2006.01)

(52) U.S. Cl. ..... 114/90

(58) Field of Classification Search ..... 114/89, 114/90, 93, 39.16, 39.32, 91, 102.11, 39.12
See application file for complete search history.

(56) References Cited

U.S. PATENT DOCUMENTS

| | | | | |
|---|---|---|---|---|
| 792,924 | A * | 6/1905 | Posgate | 114/90 |
| 2,364,578 | A * | 12/1944 | Wilkie | 114/90 |
| 3,085,539 | A * | 4/1963 | Prolss | 114/89 |
| 4,466,372 | A * | 8/1984 | Rudloff | 114/39.12 |
| 4,723,498 | A * | 2/1988 | Stampe | 114/102.1 |
| 5,313,908 | A * | 5/1994 | Kunz | 114/354 |

FOREIGN PATENT DOCUMENTS

JP 60139594 A * 7/1985

* cited by examiner

*Primary Examiner*—Ed Swinehart
(74) *Attorney, Agent, or Firm*—Barnes & Thornburg LLP

(57) ABSTRACT

A mast (1) is in the form of an egg-shaped closed loop that extends abeam of a hull (7). A main spar (2) is supported on the mast (1) and extends upwardly from a lower, fore position on the bowsprit (4) to a higher, aft position above the stern (12). A lateen sail (3) of triangular form has its longer side attached to the main spar (2) with its shorter sides depending from the main spar (2). The free corner of the sail (3) is tethered by ropes or sheets (14) to points on the sides of the hull (7) or deck such that it is positioned substantially above the centre line of the hull (7). The sail (3) can be fully deployed within the closed loop shape of the mast (1) without fouling the mast (1). This allows the sail (3) full and unrestricted deployment, results in exceptionally good sailing and provides swift and easy tacking.

41 Claims, 1 Drawing Sheet

SAILING BOATS

BACKGROUND OF THE INVENTION

The present invention relates to sailing boats.

Sailing boats have been known for thousands of years. However, there still remains a need for a sailing boat that is simple to construct and sail, whilst offering excellent performance.

Preferred embodiments of the present invention aim to provide a sailing boat having such characteristics.

SUMMARY OF THE INVENTION

According to on aspect of the present invention, there is provided a sailing boat comprising:

a hull;

a mast in the form of a closed loop that extends abeam of the hull;

a tabernacle that mounts the mast directly or indirectly on the hull;

a main spar supported on the mast with the main spar extending upwardly from a lower, fore position forward of the mast to a higher, aft position aft of the mast; and a sail depending from the main spar for deployment within the closed loop of the mast.

Said hull may be a single hull.

Said loop may be elliptical.

Preferably, said loop is ovoid, with an apex at the top of the mast.

Preferably, the maximum beam of said mast is in the range 60 to 90 percent of its height.

Preferably, the maximum beam of said mast is in the range 65 to 85 percent of its height.

Preferably, the maximum beam of said mast is in the range 70 to 80 percent of its height.

Preferably, the maximum beam of said mast is substantially 75 percent of its height.

Preferably, said mast is formed of at least one closed hollow member.

Preferably, said mast is formed of a single closed hollow member having ends that are connected at the top of the mast.

Said mast may be formed of a plurality of closed hollow members having ends that are connected at the top and the bottom of the mast.

Said tabernacle may connect said ends of said closed hollow members at the bottom of the mast Said hollow member may be at least partially filled with foam or other buoyancy-assisting material.

Preferably, said tabernacle affords movement of the mast between an operative position in which it extends abeam of the hull and a stowed position in which it extends more fore and aft of the hull.

Preferably, the mast when in said stowed position extends substantially fore and aft of the hull.

Preferably, said tabernacle affords pivoting movement of the mast between said operative position and said stowed position.

Preferably, said main spar is connected to the mast at or adjacent a top centre point of the mast.

A sailing boat according to any of the preceding aspects of the invention preferably includes stays for supporting opposite sides of the mast.

A sailing boat as above preferably includes stay adjustment means for adjusting said stays and thereby the rake of the mast.

Preferably, said main spar extends at an angle in the range 35 to 55 degrees to the horizontal.

Preferably, said main spar extends at an angle in the range 40 to 50 degrees to the horizontal.

Preferably, said main spar extends at an angle of substantially 45 degrees to the horizontal.

Preferably, said hull is provided with a bowsprit and a forward end of said main spar is located on said bowsprit, forward of the bow of the hull.

Preferably, such a sailing boat includes means for adjusting the position of said forward end of said main spar on said bowsprit.

Preferably, said main spar has a cross-section that tapers towards its upper end.

Preferably, said main spar has a degree of flexibility that increases towards its upper end.

Preferably, said mast is located at a distance from the bow of the hull that is in the range 25 to 40 percent of the length of the hull.

Preferably, said mast is located at a distance from the bow of the hull that is substantially one-third of the length of the hull.

Preferably, said sail has a lower, aft corner that is tethered substantially above the centre line of the hull.

A sailing boat as above preferably includes means for adjusting the position of said aft corner up to 100 mm either side of the centre line of the hull.

Preferably, said sail extends from a position forward of the bow of the hull to a position substantially above the stern of the hull.

Preferably, said sail is of substantially triangular shape.

Preferably, the dimensions and locations of said mast, main spar and sail are such that, when deployed, the sail cannot touch the mast.

In another aspect, the present invention provides a sailing boat comprising:

a hull;

a mast mounted directly or indirectly on the hull and comprising two opposing side portions that are joined at the top, each said side portion extending upwardly and outwardly from a respective side of the hull;

a main spar supported on the mast with the main spar extending upwardly from a lower, fore position forward of the mast to a higher, aft position aft of the mast; and a sail depending from the main spar for deployment within the area bounded by said opposing side portions of the mast.

Preferably, each said side portion of the mast extends outwardly of the hull for a distance equal to at least 20, 30, 40, 50 or 60 percent of the extreme beam of the hull.

Such a sailing boat may also be in accordance with any of the preceding aspects of the invention.

The invention extends to a sailing rig for a sailing boat according to any of the preceding aspects of the invention, the rig comprising said mast, sail and main spar.

DESCRIPTION OF THE DRAWINGS

For a better understanding of the invention, and to show how embodiments of the same may be carried into effect, reference will now be made, by way of example, to the accompanying diagrammatic drawings, in which.

DETAILED DESCRIPTION OF THE INVENTION

Figure 1:
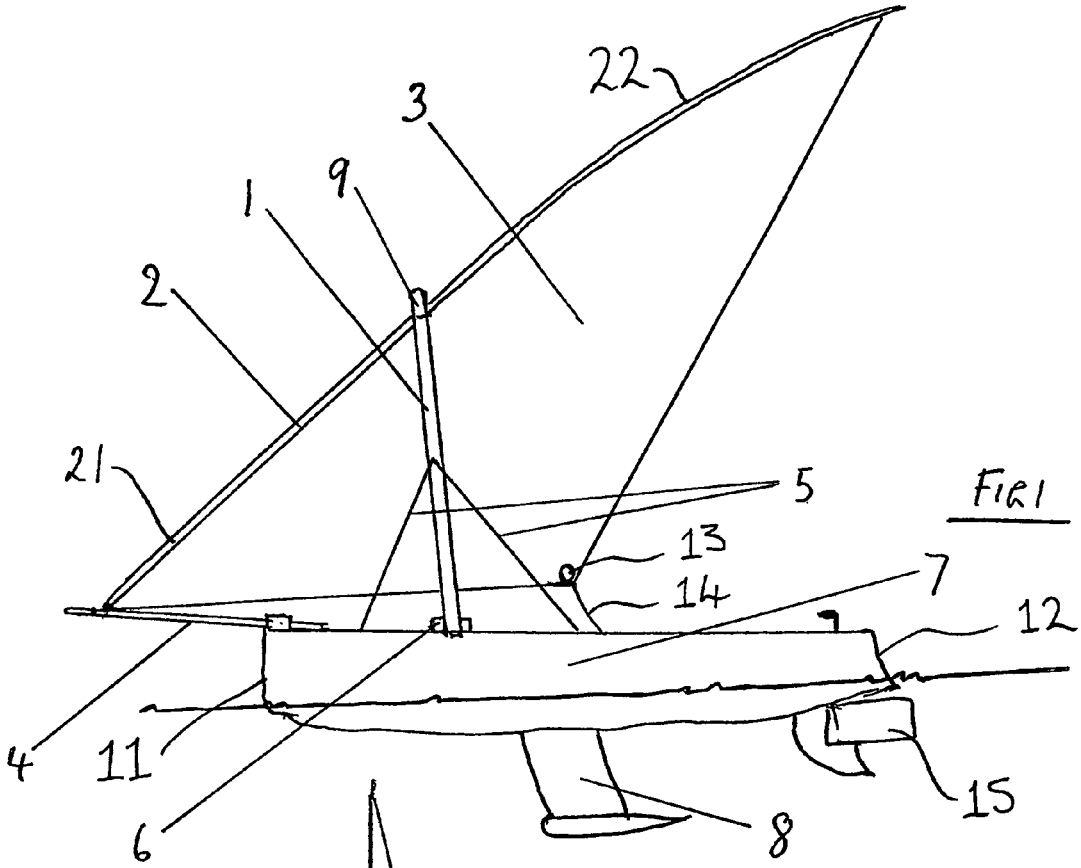
FIG. 1 shows a sailing boat in side elevation.

The illustrated sailing boat has a single hull 7 with a keel 8, bow 11, stern 12 and rudder 15. A bowsprit 4 projects forwardly of the bow 11.

A mast 1 is secured directly or indirectly to the hull 7 by a tabernacle 6.

Figure 2:
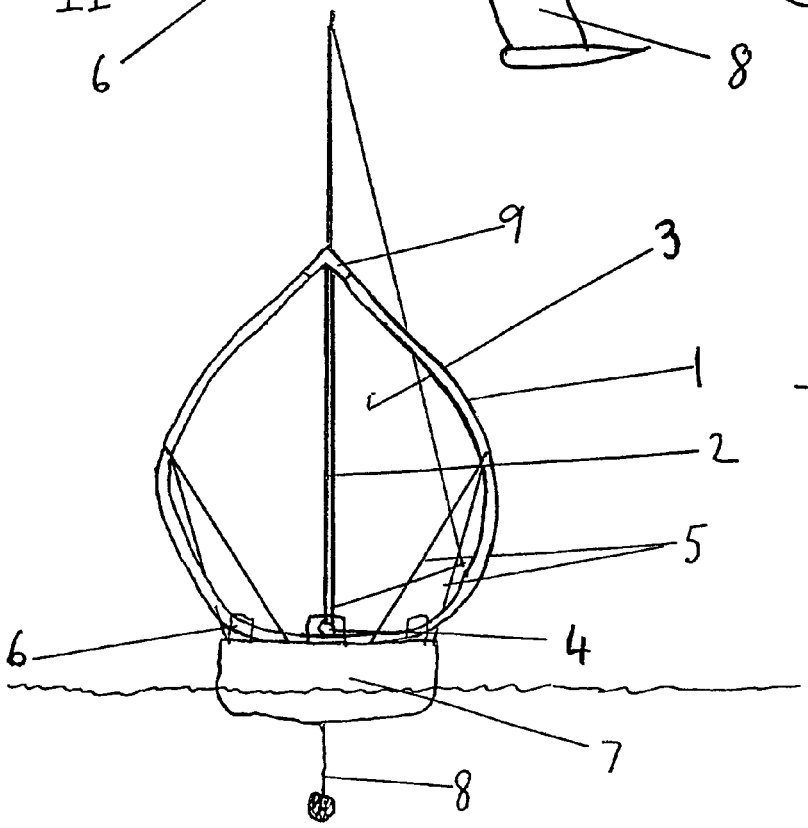
FIG. 2 is a front view of the sailing boat.

The mast 1 is in the form of a closed loop that extends abeam of the hull 7 and, as may be seen in FIG. 2, the mast 1 is generally ovoid—that is, egg-shaped. In this respect, the mast 1 has a broad base and, as each side of the loop extends upwardly, it extends outwardly, beyond the beam of the hull 7 and then upwardly up to an apex where a joining member 9 is provided. As illustrated, the mast 1 is formed of a single, dosed, hollow member having ends that are connected at right angles by the joining member 9 at the apex. Fore and aft stays 5 are connected between the sides of the mast 1 and the deck or hull 7, to secure the mast 1.

The tabernacle 6 comprises a central portion aligned with the centre line of the hull 6 to receive a lower, central portion of the mast 1, and two side portions each at or adjacent a respective side of the hull 7, to receive a respective side portion of the mast 1.

A single main spar 2 is supported on the mast 1 and extends upwardly from a lower, fore position on the bowsprit 4 to a higher, aft position above the stern 12. A sail 3 of triangular form has its longer side attached to the main spar 2 with its shorter sides depending from the main spar 2. The free corner of the sail 3—that is, the "clew" 13 is tethered by ropes or sheets 14 to points on the sides of the hull 7 or deck, such that the clew 13 is positioned substantially above the centre line of the hull 7. Such a sail 3 of triangular shape is often known as a "lateen" sail.

The main spar 2 has fore and aft parts 21, 22 that are respectively fore and aft of the mast 1. The aft part of the main spar 2 tapers in cross-section and increases in flexibility towards the aft end of the hull 7. As seen in FIG. 1, this flexibility allows the aft part 22 of the main spar 2 to assume a curved shape when the sail 3 is deployed. The flexibility of the aft part 22 of the main spar 2 also assists in absorbing any shock effects that may be encountered by the sail 3 from a sudden change in wind—for example, as in jibing.

The dimensions and locations of the mast 1, main spar 2 and sail 3 are such that, when deployed, the sail 3 cannot touch the mast 1. This is where the ovoid shape of the mast 1 is particularly important.

It will be appreciated that the construction of the illustrated sailing boat 1 is particularly simple. It has just a single sail 3 that can be fully deployed within the closed loop shape of the mast 1 without fouling the mast 1. This allows the sail 3 full and unrestricted deployment, results in exceptionally good sailing and provides swift and easy tacking. The position of the clew 13 may be sheeted to port or starboard, although a very small range of adjustment may be required—for example, up to 100 millimeters to port or starboard of the centre line of the hull 7. A wider range of adjustment may be provided if desired.

If made of a hollow, watertight construction, the mast 1 can provide buoyancy, and this may be particularly advantageous with small sailing vessels which operate dagger boards, to prevent total capsize. In this respect, the hollow mast may have a watertight void within, or the void may be filled with a foam or other buoyant material to assist buoyancy. The mast 1 may be of any suitable material—for example, metal, plastics or wood. The mast may be formed partly, principally or completely of a member that has a circular, oval, ovoid or any other suitable cross-section, whether hollow or solid.

Apart from the overall functional shape of the mast, decorative variations or additions could be made. For example, upper ends of two lateral parts of the mast 1 may have reverse curves and extend upwardly at a modified joining member 9, so that the overall shape of the mast 1 as seen in FIG. 2 has an alternative, general onion-shape.

The mast may be made of more than one tube or member. For example, it may comprise two or more tubes or members side-by-side and, optionally, interconnected continuously or intermittently.

Preferably, the tabernacle 6 affords pivotal movement of the mast 1, so that the mast 1 may be rotated through 90 degrees when not in use. This facilitates maneuvering and docking of the craft in confined locations. It is not essential for the mast to be rotatable through a full right angle. It may be sufficient for the mast 1 to be rotatable through a smaller angle, such that it extends more fore and aft of the hull than abeam of the hull—or at least remains within the external dimensions of the hull. To this end, the central portion of the tabernacle 6 may pivot itself, and the side portions of the tabernacle 6 may hold the side portions of the mast 1 releasably. Further, releasable securing means may be provided for holding the mast 1 in its stowed position.

The mast 1 may be formed of a plurality of closed, hollow members that are connected together end to end, rather than a single member. As illustrated, the joining member 9 can join upper ends of mast members. The tabernacle 6 may serve to join lower ends of mast members.

The maximum beam of the mast 1 may be approximately 75% of the height of the mast. The maximum beam may lie in the range of 60 to 90, 65 to 85 or 70 to 80 percent of the height of the mast. A suitable fixing means is provided for securing the main spar 2 to the mast 1, at or adjacent the top centre point of the mast 1. Means may be provided for adjusting the fore and aft stays 5, thereby to adjust the rake of the mast 1.

Adjustment means may be provided for adjusting the position of the forward end of the main spar 2 on the bowsprit 4. Preferably, the main spar 2 extends at an angle of approximately 45 degrees to the horizontal. The main spar may extend at an angle in the range 35 to 55 degrees or 40 to 50 degrees to the horizontal.

The mast 1 is located at a distance from the bow 11 that is approximately one-third of the length of the hull 7. The mast 1 may be located at a distance from the bow 11 that is in the range 25 to 40 percent of the length of the hull 7. As may be seen in FIG. 1, the sail 3 extends from a position forward of the bow 11 to a position approximately above the stern 12.

In addition to providing pivotal movement of the mast 1 about an upright axis for stowage, limited pivotal movement may also be afforded when under sail, in order to rotate the mast, main spar and sail slightly and thereby gain extra advantage from the wind. The limited pivotal movement may be, for example, up to 5 or 10 degrees (although further movement may be possible), and this may be particularly useful on a long tack. Additional, releasable, securing members may be provided for securing the side portions of the mast 1 when so rotated, or the side portions of the tabernacle 6 may be movable with pivotal movement of the mast 1.

Although a sail 3 of triangular shape is preferred and illustrated, alternative sails of different shapes may be employed.

Although the illustrated boat has just a single sailing rig comprising mast 1, main spar 2 and sail 3, larger boats may catty multiple rigs of similar configuration—for example, one behind the other.

Although the illustrated boat has a single hull, one or more sailing rig as illustrated may be used on multi-hull boats—for example, a catamaran or trimaran.

It is to be noted that the mast 1 provides two opposing side portions that are joined at the top, each side portion extending upwardly and outwardly from a respective side of the hull 7. It is this configuration that allows excellent deployment of the sail 3 within the mast, and to this end, each side portion of the mast may extend outwardly of the hull for a distance equal to at least 20, 30, 40 50 or 60 percent of the extreme beam of the hull 7.

It is convenient for both such side portions of the mast 1 to be mounted on the tabernacle 6 such that the mast 1 may be placed conveniently in a stowed position, as described above. However, each such mast portion may be independently mounted at a respective side of the sailing boat, and each independently moveable to a respective stowed position.

In a modification of the illustrated embodiment of the invention, approximately one-half of the mast 1 may be dispensed with and the main spar 2 supported by the remaining half of the mast. In such a modified arrangement, the mast may be mounted at the centre and one side of the hull 7, or at just the one side of the hull 7. Preferably, the modified mast extends upwardly and outwardly from its respective side of the hull 7, and then returns at a high point to substantially the centre line of the hull 7 (the position of joining member 9 as illustrated), to suspend the main spar 2.

Such a modified mast may take the shape of one-half of the mast 1 as illustrated in FIG. 2, to one side of the centre line of the hull 7. It may have alternative shapes, such as a substantially right-angled C-shape or inverted L-shape. The modified mast and/or stays such as 5 would require greater integral strength and rigidity than those in the arrangement as shown in FIG. 2. If the modified mast had sufficient integral strength and rigidity, stays such as 5 may be dispensed with. For example, the modified mast may be of tubular metal, such as aluminium. It may be telescopically adjustable in height—e.g. by way of hydraulic or pneumatic ram action.

Such a modified mast, to one side of the centre line of the hull 7, may require a counterbalance at the opposite side of the hull 7. It may be best suited to smaller boats.

According to a modified aspect of the present invention, there may be provided a sailing boat comprising:

a hull;

a mast that extends upwardly from one side of the hull and returns to a point substantially above the centre line of the hull;

a main spar supported on the mast with the main spar extending upwardly from a lower, fore position forward of the mast to a higher, aft position aft of the mast; and a sail depending from the main spar for deployment to one side of the mast.

Such a sailing boat may incorporate any of the other features disclosed in this specification.

In this specification, the term "tabernacle" has its usual meaning of a device for securing a mast to the hull of a boat, either directly or indirectly.

In this specification, the term "main spar" means the member that provides the principal mounting for the sail. In most modern sail rigs, the mainsail is mounted principally on a boom that extends substantially horizontally from an upright mast. In the present specification, the main spar provides the function of principal mounting for the sail, which function would normally be provided by the boom in, say, a Bermuda rig. That is, in this specification, the boom at the bottom of a mainsail is effectively replaced by the main spar at the top of the sail.

In this specification, the verb "comprise" has its normal dictionary meaning, to denote non-exclusive inclusion. That is, use of the word "comprise" (or any of its derivatives) to include one feature or more, does not exclude the possibility of also including further features.

The reader's attention is directed to all and any priority documents identified in connection with this application and to all and any papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A sailing boat comprising:

a hull;

a mast that is mounted directly or indirectly on the hull so as to be substantially fixed in use, extends upwardly at one side of the hull, outwardly beyond said side of the hull, and then inwardly to a point substantially above the centre line of the hull;

a main spar supported on the mast with the main spar extending upwardly from a lower, fore position forward of the mast to a higher, aft position aft of the mast; and a sail depending from the main spar for deployment to one side of the mast:

wherein said mast extends outwardly of the hull for a distance equal to at least 20 percent of the extreme beam of the hull.

2. A sailing boat according to claim 1, wherein said mast is mounted so as to afford movement of the mast between an operative position in which it extends abeam of the hull and a stowed position in which it extends more fore and aft of the hull.

3. A sailing boat according to claim 2, wherein the mast when in said stowed position extends substantially fore and aft of the hull.

4. A sailing boat according to claim 2, wherein said movement comprises pivoting movement of the mast between said operative position and said stowed position.

5. A sailing boat according to claim 1, including stays for supporting opposite sides of the mast.

6. A sailing boat according to claim 5, including stay adjustment means for adjusting said stays and thereby the take of the mast.

7. A sailing boat according to claim 1, wherein said main spar extends at an angle in the range 35 to 55 degrees to the horizontal.

8. A sailing boat according to claim 7, wherein said main spar extends at an angle in the range 40 to 50 degrees to the horizontal.

9. A sailing boat according to claim 8, wherein said main spar extends at an angle of substantially 45 degrees to the horizontal.

10. A sailing boat according to claim 1, wherein said mast extends outwardly of the hull for a distance equal to at least 30 percent of the extreme beam of the hull.

11. A sailing boat according to claim 1, wherein said mast extends outwardly of the hull for a distance equal to at least 40 percent of the extreme beam of the hull.

12. A sailing boat according to claim 1, wherein said mast extends outwardly of the hull for a distance equal to at least 50 percent of the extreme beam of the hull.

13. A sailing boat according to claim 1, wherein said mast extends outwardly of the hull for a distance equal to at least 60 percent of the extreme beam of the hull.

14. A sailing boat comprising:

a hull;

a mast that is mounted directly or indirectly on the hull so as to be substantially fixed in use, and comprises a pair of opposing side portions, each of which extends upwardly at a respective side of the hull, outwardly beyond said side of the hull, and then inwardly to a point substantially above the centre line of the hull, where said side portions are joined;

a main spar supported on the mast with the main spar extending upwardly from a lower, fore position forward of the mast to a higher, aft position aft of the mast; and a sail depending from the main spar for deployment between said opposing side portions:

wherein said mast extends outwardly of the hull for a distance equal to at least 20 percent of the extreme beam of the hull.

15. A sailing boat according to claim 14, wherein the maximum width of said mast is in the range 60 to 90 percent of its height.

16. A sailing boat according to claim 15, wherein the maximum width of said mast is in the range 65 to 85 percent of its height.

17. A sailing boat according to claim 16, wherein the maximum width of said mast is in the range 70 to 80 percent of its height.

18. A sailing boat according to claim 17, wherein the maximum width of said mast is substantially 75 percent of its height.

19. A sailing boat comprising:

a hull;

a mast that is mounted directly or indirectly on the hull so as to be substantially fixed in use, and comprises a pair of opposing side portions, each of which extends upwardly at a respective side of the hull, and then inwardly to a point substantially above the centre line of the hull, where said side portions are joined;

a main spar supported on the mast with the main spar extending upwardly from a lower, fore position forward of the mast to a higher, aft position aft of the mast; and a sail depending from the main spar for deployment between said opposing side portions:

wherein the maximum width of said mast is at least 60 percent of its height.

20. A sailing boat according to claim 19, wherein said hull is a single hull.

21. A sailing boat according to claim 19, wherein said opposing mast portions define a loop that is elliptical.

22. A sailing boat according to claim 19, wherein said opposing mast portions define a loop that is ovoid, with an apex at the top of the mast.

23. A sailing boat according to claim 19, wherein said mast is formed of at least one closed hollow member.

24. A sailing boat according to claim 23, wherein said mast is formed of a single closed hollow member having ends that are connected at the top of the mast.

25. A sailing boat according to claim 23, wherein said mast is formed of a plurality of closed hollow members having ends that are connected at the top and the bottom of the mast.

26. A sailing boat according to claim 25, wherein a tabernacle connects said ends of said closed hollow members at the bottom of the mast.

27. A sailing boat according to claim 23, wherein said hollow member is at least partially filled with foam or other buoyancy-assisting material.

28. A sailing boat according to claim 19, wherein said main spar is connected to the mast at or adjacent a top centre point of the mast.

29. A sailing boat according to claim 19, wherein said hull is provided with a bowsprit and a forward end of said main spar is located on said bowsprit, forward of the bow of the hull.

30. A sailing boat according to claim 29, including means for adjusting the position of said forward end of said main spar on said bowsprit.

31. A sailing boat according to claim 19, wherein said main spar has a cross-section that tapers towards its upper end.

32. A sailing boat according to claim 19, wherein said main spar has a degree of flexibility that increases towards its upper end.

33. A sailing boat according to claim 19, wherein said mast is located at a distance from the bow of the hull that is in the range 25 to 40 percent of the length of the hull.

34. A sailing boat according to claim 33, wherein said mast is located at a distance from the bow of the hull that is substantially one-third of the length of the hull.

35. A sailing boat according to claim 19, wherein said sail has a lower, aft corner that is tethered substantially above the centre line of the hull.

36. A sailing boat according to claim 35, including means for adjusting the position of said aft corner up to 100 mm either side of the centre line of the hull.

37. A sailing boat according to claim 19, wherein said sail extends from a position forward of the bow of the hull to a position substantially above the stern of the hull.

38. A sailing boat according to claim 19, wherein said sail is of substantially triangular shape.

39. A sailing boat according to claim 19, wherein the dimensions and locations of said mast, main spar and sail are such that, when deployed, the sail cannot touch the mast.

40. A sailing boat according to claim 19, wherein said mast extends outwardly of the hull for a distance equal to at least 20 percent of the extreme beam of the hull.

41. A sailing boat according to claim 19, wherein said mast is in the form of a closed loop.

* * * * *